United States Patent [19]

Gerlach

[11] 4,215,557

[45] Aug. 5, 1980

[54] LOCK WITH KEY SLOT MANIPULATION BARRIER

[75] Inventor: John R. Gerlach, Monterey Park, Calif.

[73] Assignee: Emhart Industries, Inc., Farmington, Conn.

[21] Appl. No.: 946,818

[22] Filed: Sep. 28, 1978

[51] Int. Cl.[2] ..... E05B 63/00

[52] U.S. Cl. ..... 70/417; 70/375

[58] Field of Search ..... 70/417, 423, 375, 377, 70/421, 376

[56] References Cited

U.S. PATENT DOCUMENTS

| | | | |
|---|---|---|---|
| 1,422,519 | 7/1922 | Augenbraun | 70/417 |
| 3,319,443 | 5/1967 | Perlick | 70/417 |
| 3,410,123 | 11/1968 | Jacobi | 70/417 |

FOREIGN PATENT DOCUMENTS

| | | | |
|---|---|---|---|
| 7602479 | 3/1976 | Netherlands | 70/417 |

*Primary Examiner*—Robert L. Wolfe

*Attorney, Agent, or Firm*—Mahoney & Schick

[57] ABSTRACT

A rotatable lock plug having a key slot formed entirely axially therethrough has a barrier secured in the lock plug adjacent the key slot inner end between an inner end of a key received in the key slot and a torque blade operably connected to the lock plug inner end for providing a barrier denying surreptitious access through the key slot. The barrier has edge portions received in appropriate lock plug recesses and preferably a flat portion transversely spanning the key slot. In one form, the barrier may be an axially slotted pin receiving the key end within the slot, and in other forms may be edge secured, flat plates.

14 Claims, 12 Drawing Figures

LOCK WITH KEY SLOT MANIPULATION BARRIER

BACKGROUND OF THE INVENTION

This invention relates to a lock with key slot manipulation barrier therein and more particularly, to a rotatable lock plug having a key slot formed axially therethrough wherein a barrier is positioned secured in the lock plug at an inner end of the lock plug effectively blocking the key slot against surreptitious attempted manipulation therethrough and manipulation of the various connected components controlled by the lock. Even more particularly, this invention relates to a lock plug having the key slot guarding barrier of the foregoing general character wherein the barrier is specifically and uniquely formed adapted to occupy a minimum of lock plug axial space directly at the effective working area of the key slot so as to minimize the required axial length of the particular lock plug, yet the barrier is securely retained in its blocking position and efficiently serves its required key slot blocking function.

The use of so-called "armor pins," that is, hardened cylindrical pins, as shields or barriers in locks for guarding various of the important lock components has been well known to those skilled in the lock art for a lengthy period of time. For instance, particularly before the improved and more sophisticated metals of today and the methods of working the same were available, lock security could be violated by drilling through exposed parts thereof into the inner lock confines for gaining manipulative access to the various lock working elements. Barriers were therefore installed, a somewhat common form being in the pin-tumbler locks wherein an armor pin would be installed in the lock plug positioned directly forward of the first pin-tumbler to protect the pin-tumblers from such drilling access and ultimate manipulation.

Although the improvement and progress in the lock arts and the availability of improved metals temporarily eliminated the necessity of the increased guarding of the various lock elements so that the use of armor pins was, in most cases, eliminated, changes in lock production procedures for time and cost savings ultimately required a rethinking of the lock guarding structures. A major change was the formation of the key slots of the lock plugs totally axially therethrough with the usual radially extending levers secured to the lock plug inner ends, usually adjacent the open key slot inner end. In any event, with the key removed, the open key slot provided access through the key slot inner end and access to either the lock plug connected lever or to the various elements controlled by the lock.

Thus, armor pins were once again used to deny drilling and other penetrating access through the open key slots. This was done merely by drilling a cylindrical hole aligned with the key slot adjacent the lock plug inner end and installing a press fit armor pin totally blocking the key slot. Of course, the armor pin was required to be positioned across the key slot axially inward of the usual penetration by the proper key when inserted in the key slot.

Still in more recent years, the lock art has progressed to the use of torque blades in one form or another for connecting the lock plug to the particular elements or mechanisms controlled thereby, frequently door bolt mechanisms. Furthermore, the torque blades are attached to the lock plugs through lost motion connections so that the lock key is always removable in a common neutral position. In other words, with the lock plug and inter-connected bolt mechanism connected through the torque blade and lost motion connection of the torque blade to the lock plug inner end, turning of the key in one direction will extend the bolt and the key may be returned to its neutral position through lost motion not affecting the position of the bolt, the withdrawal of the bolt being similar, but in the opposite direction of key movement.

One general construction of lock and bolt mechanism assembly exemplifying this arrangement includes the lock plug having the key slot formed axially therethrough, an axially extending torque blade, and one end of the torque blade lost motion connected to the lock plug inner end and the other end of the torque blade secured with the bolt mechanism for actuating the same to move the bolt. The lost motion connection between the torque blade and the lock plug inner end is created by either inserting the torque blade end into an end-opening recess of the lock plug or telescoping the torque blade end over the lock plug end, in either case, connecting the lock plug and torque blade for rotation transmission therebetween through a slot and pin arrangement providing the limited lost motion. The important consideration is that with the torque blade end, whether recess received or telescoped with the lock plug end, the inner open end of the key slot is completely covered and thereby obstructed by the torque blade so that the torque blade prevents any manipulation through the key slot and the barrier created by armor pins is unnecessary. Thus, the armor pin was again eliminated.

Although this more recent torque blade and lock arrangement has appeared to provide sufficient key slot access blocking for frustrating attempted manipulations, with the more sophistication and adeptness of the criminal element attempting to surreptitiously manipulate the locks, it has been determined that some form of the prior static or absolute blocking of the key slot will provide added assurance that complete key slot access blocking is maintained, for instance, similar to the cylindrical armor pin blocking of the prior locks. However, with the lost motion connection between the lock plug and torque blade ends occupying an increment of the lock plug inner end portion, a distinct problem is presented. That problem is one of lock plug axial space, the space required for positioning a cylindrical armor pin at the inner end of the key slot while still not interfering with the key outwardly thereof and the lost motion connection inwardly thereof.

If the lock is to have the maximum number of pin-tumblers and such pin-tumblers are of sufficient size, all for the required maximum locking security, the key must be of a determined axial length. This means that the key, when in proper unlocking position received in the lock plug key slot will occupy all but a very small inner axial portion of the lock plug. Thus, it has been found that there simply is not sufficient axial length of the lock plug remaining between the key inner end when properly positioned in the key slot and the torque blade lost motion connection at the lock plug inner end portion to install a normal cylindrical armor pin in the lock plug of sufficient size as had heretofore been used for fully blocking the key slot and being securely retained in such blocking position, that is, without increasing the lock plug axial length and, therefore, the overall lock dimensions, which can cause serious prohibitive problems in lock installation, as well as increased lock costs.

In an effort to solve this problem of providing adequate key slot blocking while still maintaining the required lock plug length and other component sizes, various attempts have been made to provide some form of shield of altered shape from the prior fully cylindrical armor pin occupying the very limited axial space of the lock plug between the key inner end and the torque blade lost motion connection to the lock plug. These attempts have involved the lost motion connection between the lock plug inner end and the end of the torque blade being formed by the inwardly opening, axial recess in the lock plug inner end receiving the torque blade end therein. Flat plates or cup-shaped members have been press fit with a maximum possible compression in the lock plug lost motion recess fully blocking the key slot outwardly of the torque blade end, but these attempts fail due to the fact that it is found to be impossible to provide sufficient press fit compression between these shields and the lock plug to prevent the shields being dislodged by an adequate punch inserted fully into the key slot from the outer end when the key is not present.

OBJECTS AND SUMMARY OF THE INVENTION

It is, therefore, an object of this invention to provide a lock with a key slot manipulation barrier which effectively solves the foregoing problems in a unique and efficient manner. The barrier is of sufficient size to fully block the key slot inner end, while of sufficient thickness and radial dimensions for secure retainment assembled in the lock plug against inward axial forces thereon. Equally importantly, the barrier occupies a minimum of effective lock plug axial space at the lock plug key slot, far less than required for the prior fully cylindrical armor pins.

In one preferred embodiment of the present invention, the barrier extends radially across the lock plug key slot fully blocking the key slot and has edge portions radially oppositely engaging in the lock plug and axially forwardly within the lock plug adjacent or directly along the key slot. Thus, the only portion of the barrier directly axially between a positioned key inner end and the torque blade lost motion connection is a central portion of the barrier with the forwardly projecting barrier edge portions within the lock plug adjacent or axially along the key slot having no affect on the critical axial spacing, although clearly required for secure barrier retention. In this form, therefore, the inner key end may lightly abut the barrier central portion when properly installed in the key slot and this barrier central portion is only required to be slightly forwardly spaced from the torque blade end and its lost motion connection so that it does not at any time interfere with the torque blade and lost motion connection movement.

An optimum specific form of the foregoing preferred embodiment is a cylindrical, hardened pin having an axially extending slot formed therein which is secured in a complementary cylindrical hole radially of the lock plug aligned with the key slot. The pin slot is aligned opening forwardly of the key slot and of the approximate width for properly receiving the inner key end while the overall size of the pin is sufficient that opposite edge portions thereof are received in the opening at opposite sides of the key slot. This slotted pin, therefore, is securely retained in the lock plug against relative axial movement in either axial direction of the lock plug by its edge portions engaging in the body of the lock plug just radially of the key slot while the properly positioned key inner end may engage in the pin slot, and the pin thickness effectively blocking the lock plug key slot, although efficiently performing its key slot blocking function, is greatly reduced. Furthermore, the effect of such thickness may be even further minimized by forming the blocking pin central portion radially flat.

Other preferred embodiments of the present invention may include mere flat plates specifically sized for radially central portions thereof to extend across and fully axially block the lock plug key slot while edge portions thereof are received in the body of the lock plug retaining the flat plates against axial dislodgment in either axial direction of the lock plug. For such flat plate retention, the lock plug is partially radially slotted with such slotting being formed through the body of the lock plug such that a specific shape of flat plate may be radially inserted therein and into proper key slot blocking position. Again, although the flat plate thicknesses are sufficient for preventing axial penetration at the lock plug key slot, these thicknesses are appreciably reduced from that which has heretofore been required in performing the same barrier function.

It is a further object of this invention to provide a lock with a key slot manipulation barrier of the foregoing general character and providing the specific advantages enumerated, yet which may be economically produced and efficiently installed with a minimum increased production cost. Regardless of the particular shape satisfying the requirements of the present invention, the material and labor costs for providing the same under modern production procedures are only minimal in overall lock construction costs. Also, the added labor costs for installing the same in the lock cylinders is relatively minor.

It is another object of this invention to provide a lock with a key slot manipulation barrier of the foregoing general type which has virtually universal application for efficient key slot blocking function in any keyed lock construction. Although the general type of lock construction hereinbefore discussed for illustrative purposes has been the pin-tumbler type of lock, the key slot barrier principles of the present invention have ready application to other types of keyed locks. For instance, the same problems can be present and the same solutions applied to keyed disc-tumbler locks, as will be obvious to those skilled in the art.

Other objects and advantages of the invention will be apparent from the following specification and the accompanying drawings which are for the purpose of illustration only.

DESCRIPTION OF THE BEST EMBODIMENTS CONTEMPLATED

Figure 1:
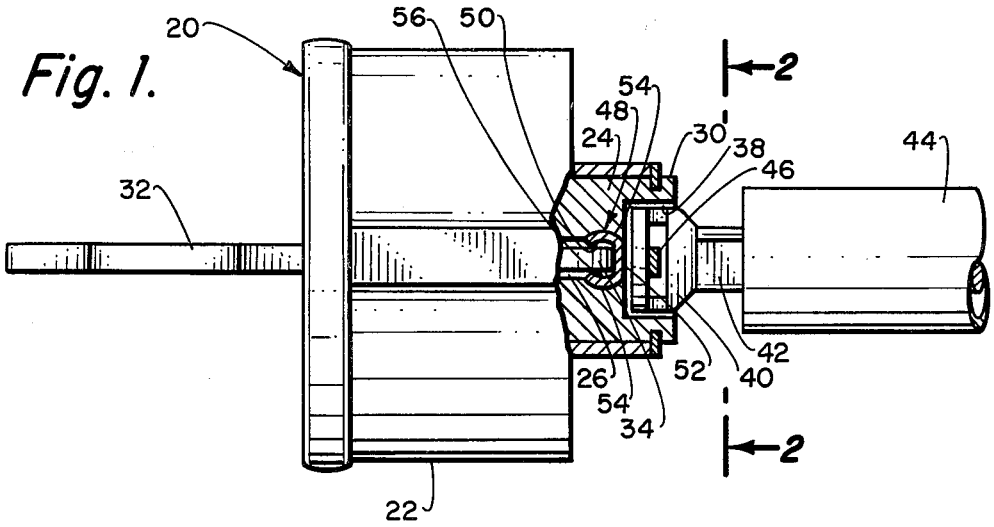
FIG. 1 is a fragmentary, top plan view, part in section, of a pin-tumbler lock and bolt mechanism assembly incorporating a first preferred embodiment of the key slot manipulation barrier of the present invention.
Figure 2:
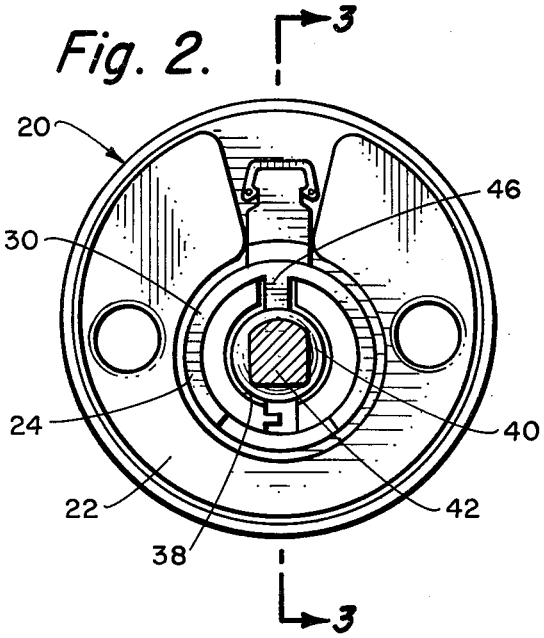
FIG. 2 is a vertical sectional view looking in the direction of the arrows 2—2 in FIG. 1.
Figure 4:
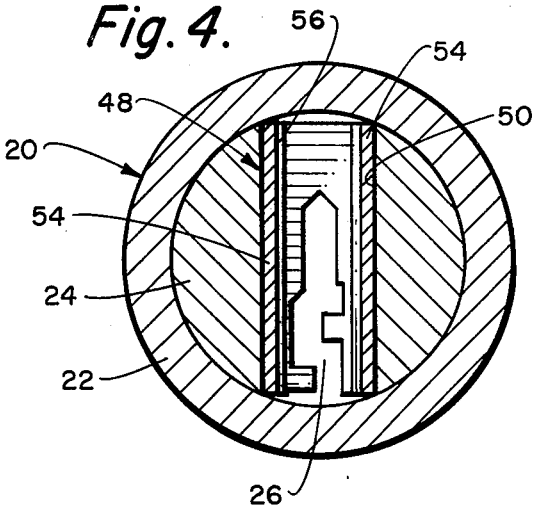
FIG. 4 is an enlarged, vertical sectional view looking in the direction of the arrows 4—4 in FIG. 3.
Figure 3:
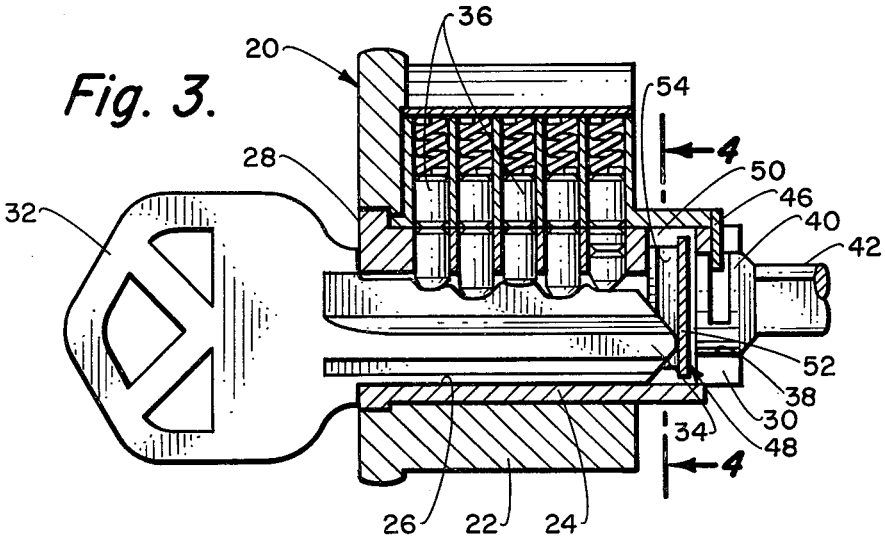
FIG. 3 is a vertical sectional view looking in the direction of the arrows 3—3 in FIG. 2.
Figure 5:
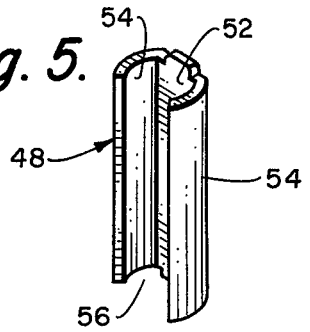
FIG. 5 is an enlarged, perspective view of the key slot manipulation barrier of FIGS. 1 and 3 looking primarily at the front slotted side thereof.
Figure 6:
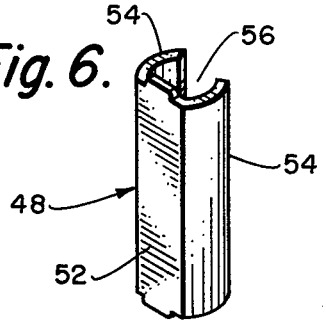
FIG. 6 is a perspective view similar to FIG. 5, but primarily looking at the backside of the key slot manipulation barrier.

Referring to FIGS. 1 through 6 of the drawings, a first preferred embodiment of the key slot manipulation barrier of the present invention is illustrated in the environment of a somewhat usual pin-tumbler lock generally indicated at 20, the lock including a lock cylinder casing 22 rotatably mounting a lock cylinder plug 24. The lock plug 24 has a usual radially elongated key slot 26 formed axially therethrough opening axially outwardly of a lock plug outer end 28 and normally opening axially inwardly of a lock plug inner end 30. The key slot 26 is adapted for receiving an appropriate and complementary formed key 32 inserted axially therein from the lock plug outer end 28 toward the lock plug inner end 30 and when the key 32 is fully inserted in unlocking final operable position as shown in FIGS. 1 and 3, the key occupies nearly the entire axial length of the lock plug 24 with a key inner end 34 slightly axially spaced from the lock plug inner end 30 toward lock plug outer end 28.

Appropriate radially inwardly resiliently urged pin-tumblers 36 of usual split-pin form are mounted axially aligned in the lock casing 22 and lock plug 24 radially movable partially in each normally radially urged into the key slot 26. When the key 32 is not present in the key slot 26 (not shown), the pin-tumblers 36 are urged radially into the key slot sufficient that the outer portions thereof will block the usual parting line formed by the separation between the lock casing and plug 22 and 24, thereby placing the lock 20 in locked condition. However, when the key 32 is in its fully inserted unlocking position in the key slot 26 as shown in FIG. 3, the pin-tumblers 36 are urged radially outwardly, received in appropriate notches of the key, so that the separation between parts of each pin-tumbler 36 is exactly at the parting line, thereby permitting rotation of the lock plug 24 within the lock casing 22 by the key. Again as is usual, it will be noted that the innermost pin-tumbler 36 is axially spaced outwardly from the key inner end 34 in order that that pin-tumbler will be supported by the key 32 in the described unlocking position.

The lock plug inner end 30 is formed with an axially inwardly opening recess 38 which receives an enlarged, slotted end 40 of a torque blade 42. The torque blade 42 is coaxial of the lock plug 24 and projects axially inwardly from the lock 20 into and is secured for rotating a hub 44 of a usual bolt mechanism (not shown). The torque blade end 40 is operably connected to the lock plug 24 through a usual clip 46 engaged in the slot of the torque blade end providing a limited lost motion connection between the lock plug 24 and the torque blade 42, that is, when the lock 20 is in an unlocked condition and the key 32 is in its neutral, vertically extending position, the position shown in FIGS. 1 and 3, the key may be rotated to actuate the bolt mechanism and extend the bolt thereof, and through the lost motion connection between the lock plug 24 and torque blade 42, the key may be reversely rotated back to its neutral position without effecting the extended position of the bolt. The reverse is true by virtue of this lost motion connection in retraction of the bolt, all well known to those skilled in the art.

More particularly to the manipulation barrier principles of the present invention, it will be noted that with the key 32 removed and the key slot 26 extending entirely axially through the lock plug 24, the end 40 of the torque blade 42 would normally be accessible through the key slot, thereby providing access through the key slot against the torque blade for attempting to surreptitiously manipulate the torque blade and/or the internal elements connected for operation by the lock, such as the hub 44 or other parts of the bolt mechanism. Thus, in order to provide maximum security for the lock 20, it is highly desirable to block the inner end of the key slot 26 by some form of static or permanently positioned barrier which is difficult to axially penetrate. However, the basic problem involved with providing such a barrier is the fact that even though the innermost pin-tumbler 36 is spaced axially outward of the key inner end 34 within the lock plug 24, there is only a minimum of axial space between the key inner end 34 when properly inserted in unlocking position and the end of the lock plug recess received torque blade 42 as shown in FIGS. 1 and 3. Furthermore, the key inner end 34 and any key slot barrier therefor must not interfere with free lost motion relative rotation between the lock plug 24 and the torque blade 42.

According to the principles of the present invention, a first embodiment barrier generally indicated at 48 is positioned in the lock plug 24 generally radially at and lengthwise aligned with the key slot 26. The barrier 48 is generally of cylindrical pin configuration and is received, preferably press fit, in a radially extending cylindrical opening 50 of the lock plug, the opening being generally radially aligned with the key slot 26 and just axially outward, preferably very slightly inwardly interfering axially with, the torque blade recess 38 at the lock plug inner end 30. The barrier cylindrical opening 50 in cross section is spaced larger than the radial width of the key slot 26 so that it projects radially arcuately into the lock plug 24 at opposite sides of the key slot, the barrier 48 generally conforming to the cylindrical opening and having a central portion 52 radially spanning the key slot with the opposite edge portions 54 radially and axially engaging the lock plug radially outward of the key slot.

Still further, the barrier 48 is formed with a slot 56, preferably totally lengthwise thereof and opening axially toward the lock plug outer end 28 or axially away from the lock plug inner end 30 and the torque blade recess 38. The barrier slot 56 is aligned with the key slot 26 and is of at least sufficient radial width to accommodate the key inner end 34 therein. For axial space conservancy, the barrier central portion 52 is preferably generally flat projecting flatwise radially across the key slot 26 preferably exactly at but not axially entering the torque blade recess 38, and for maximum engagement within the lock plug cylindrical opening 50, the barrier edge portions 54 preferably project arcuately axially forwardly within the lock plug 24 radially adjacent the key slot, all as shown in FIGS. 1 through 6.

Thus, the described first embodiment barrier 48 very effectively blocks the key slot 26 and by forming the barrier of the usual high-strength materials such as hardened steel and the like, penetration thereof will be frustrated. Furthermore, with the secure engagement of the barrier 48 in the lock plug 24 and its positioning fully blocking the key slot 26, circumvention thereof will be frustrated. Still further, and quite important to the principles of the present invention, due to the configuration of the barrier 48 with its slot 56 accommodating the key inner end 34 at its preferred flat central portion 52, secure engagement in the lock plug 24 is maintained while still providing a maximum of lock plug axial space conservancy permitting the barrier to be positioned in the lock plug minimum axial space between the key inner end 34 and the torque blade recess 38 without functionally interfering with either. The lock 20 is, therefore, always fully operable in conventional manner despite the added security of the key slot blocking barrier 48.

Figure 7:
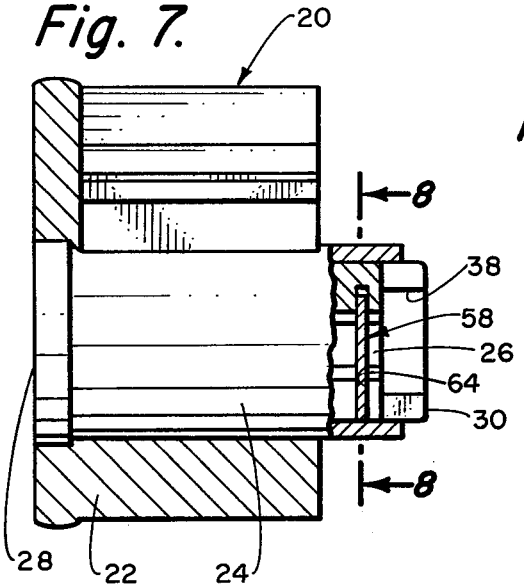
FIG. 7 is a vertical sectional view of the pin-tumbler lock of FIGS. 1 through 4, but incorporating a second preferred embodiment of key slot manipulation barrier of the present invention.
Figure 8:
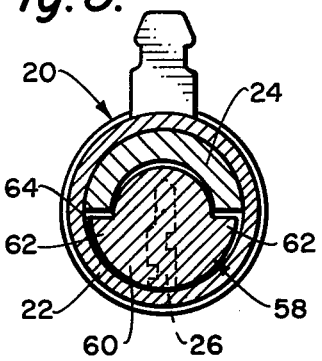
FIG. 8 is a vertical sectional view looking in the direction of the arrows 8—8 in FIG. 7.
Figure 9:
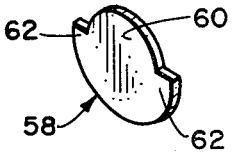
FIG. 9 is a perspective view of the key slot manipulation barrier removed from the lock of FIGS. 7 and 8.

A second preferred embodiment barrier generally indicated at 58 and according to certain of the principles of the present invention is shown in FIGS. 7 through 9, in this case, the barrier preferably being a flat plate barrier formed of the usual high-strength materials as hereinbefore pointed out. As shown, therefore, the barrier 58 includes a radially flat central portion 60 and radially flat opposite edge portions 62. Furthermore, the barrier 58 is positioned in the lock plug 24 preferably press fit in a normally downwardly opening, radial lock plug slot 64, the slot being in the lock plug inner end 30 spaced outwardly axially adjacent the torque blade recess 38. As can be seen particularly in FIG. 8, the barrier 58 and its slot 64 occupy approximately one-half of the radial dimensions of the lock plug 24 out to the lock casing 22 with the barrier being formed of greater radial dimensions arcuately over the upper end of the key slot 26 so as to fully cover and axially block the key slot while still permitting assembly by radial insertion into the lock plug slot.

Figure 10:
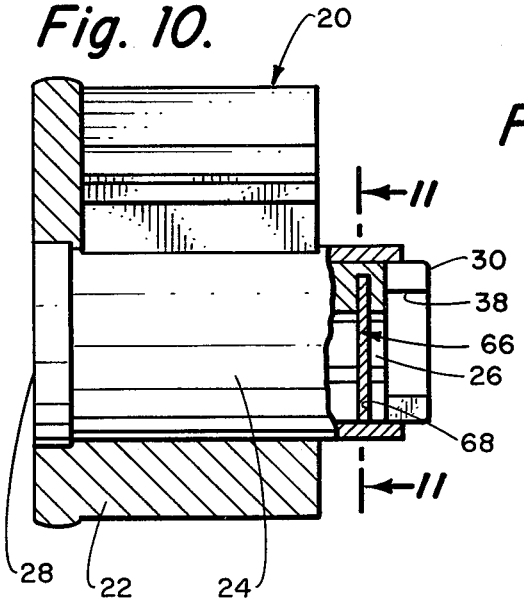
FIG. 10 is a view similar to FIG. 7, but with the lock incorporating a third embodiment of key slot manipulation barrier of the present invention.
Figure 11:
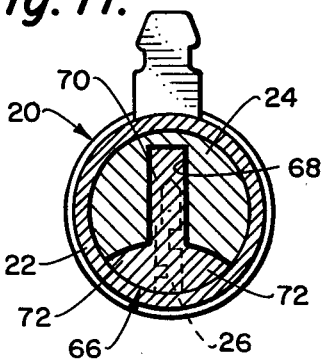
FIG. 11 is a vertical sectional view looking in the direction of the arrows 11—11 in FIG. 10.
Figure 12:
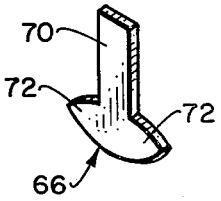
FIG. 12 is a perspective view of the key slot manipulation barrier removed from the lock of FIGS. 10 and 11.

A third preferred embodiment barrier generally indicated at 66 is shown in FIGS. 10 through 12 and is quite similar to the second embodiment barrier 58, only of slightly different shape and of lesser radial extent. Barrier 66 is similarly received preferably press fit in a lock plug radial slot 68, as in the second embodiment, the slot being complementary in shape to the particular barrier and spaced axially outwardly adjacent the torque blade recess 38 within the lock plug 24. The barrier 66 in axial view as shown in FIG. 11 is generally reverse T-shape having a squared off, radially flat central portion 70 fully radially spanning and blocking the lock plug key slot 26 and radially opposite flat edge portions 72 engaging the lock plug radially adjacent the key slot and having a lower part projecting a greater extent radially. Thus, the third embodiment barrier 66 may likewise be radially inserted into the lock plug 24 for assuming its key slot blocking position.

In all three embodiments of the present invention, therefore, each in its preferred form, the barriers 48 or 58 or 66 extend radially flatwise across the key slot 26 totally encompassing and axially blocking the same while still only occupying a minimum of axial space at the key slot so as to not interfere with the function of either the key 32 or the torque blade 42. In the first embodiment, the key inner end 34 is received in the barrier slot 56, while in the other embodiments, the key inner end may be closely adjacent the outer sides of the barriers 58 and 66. At the same time, all barrier embodiments are securely retained positioned in the lock plug 24 against any axial movement, particularly the more important inward axial movement and forced or otherwise, by secure engagement radially into the lock plug 24 radially adjacent the key slot 26. With the first embodiment barrier 48, the forwardly arcuate edge portions 54 provide secure engagement with the lock plug 24, while with the second embodiment barrier 48 or the third embodiment barrier 66, the respective preferably flat edge portion 62 or 72 securely engage in the lock plug radially adjacent the key slot. Thus, very effective key slot blocking barriers are provided despite a minimum of available lock plug axial space, all according to the unique principles of the present invention.

Finally, it is pointed out that the unique key slot manipulation barrier principles of the present invention have ready application to virtually any type of keyed lock. Although the principles of the present invention have been illustrated herein involved with and in the environment of a typical pin-tumbler lock, there are other types and forms of keyed locks which may make use of the principles of the present invention with no or slight alteration. Such is fully contemplated herein and the principles of the present invention should not be limited beyond the specific limitations of the appended claims and the equivalents accorded thereto.

I claim:

1. In a lock of the type having a lock cylinder directly rotatably telescoping a lock plug with a parting line directly therebetween and with a key slot totally axially through the lock plug, the key slot being adapted to receive a proper key inserted axially into an outer end of the lock plug and into a final operable position with an inner end of the key within the lock plug spaced axially from an inner end of the plug, an axially extending torque blade directly connected to the inner end of the lock plug through a limited lost motion drive permitting limited relative rotation between the plug and torque blade and rotative driving connection therebetween at ends of the limited lost motion drive; the improvements comprising: a barrier positioned substantially totally in said lock plug having a substantially flat central portion extending radially across and axially blocking said key slot axially between said key inner end and said torque blade when said key is positioned in said final operable position in said plug key slot, said barrier having edge portions received in radial recesses of said lock plug opening radially into said key slot retaining said barrier at all times rotatable with said lock plug and against axial movement in either axial direction at all times spaced from and free of contact with said torque blade.

2. In a lock as defined in claim 1 in which said barrier includes a pin extending radially of said lock plug generally aligned with said key slot and having a substantially flat central portion extending radially across and axially blocking said key slot, said pin being positioned substantially totally in said lock plug rotatable at all times therewith and spaced at all times from said torque blade.

3. In a lock as defined in claim 1 in which said barrier is substantially flat throughout including a substantially flat central portion terminating radially in substantially flat edge portions positioning said barrier at all times substantially totally within said lock plug rotatable therewith and spaced from said torque blade.

4. In a lock as defined in claim 1 in which parts of said lock plug recesses receiving said barrier edge portions open radially outward of said lock plug constructed and arranged for permitting slideable assembly of said barrier with said lock plug into said key slot axially blocking position and with said barrier at all times substantially totally within said lock plug rotatable therewith and spaced from said torque blade.

5. In a lock as defined in claim 1 in which said barrier is substantially flat throughout including a substantially flat central portion terminating radially in substantially flat edge portions; and in which parts of said lock plug recesses receiving said barrier edge portions open radially outward of said lock plug constructed and arranged for permitting slideable assembly of said barrier with said lock plug into said key slot axially blocking position and with said barrier at all times substantially totally within said lock plug rotatable therewith and spaced from said torque blade.

6. In a lock as defined in claim 1 in which said lock plug recesses receiving said barrier edge portions are formed by a cylindrical opening radially of said lock plug generally aligned with said key slot and forming said recesses radially adjacent said key slot.

7. In a lock of the type having a rotatable lock plug with a key slot axially therethrough, the key slot being adapted to receive a proper key inserted axially into an outer end of the lock plug and into a final operable position with an inner end of the key within the lock plug spaced axially from an inner end of the plug; the improvements comprising: a barrier in said lock plug extending generally radially of said plug at said key inner end and retained by said plug against movement axially of said plug, said barrier in said plug retention being aligned with said plug key slot and having a central portion spanning and axially blocking said key slot with opposite edge portions projecting forwardly of said central portion axially toward said lock plug outer end at sides of said key slot.

8. In a lock as defined in claim 7 in which said barrier includes said central portion and said opposite edge portions forming barrier recess means opening toward said plug outer end for receiving a portion of said key inner end therein when said key is positioned in said final operable position in said plug key slot.

9. In a lock as defined in claim 7 in which said barrier includes said central portion being generally flat and extending generally radially of said lock plug spanning and axially blocking said key slot and said opposite edge portions being generally arcuate and projecting forwardly axially toward said lock plug outer end.

10. In a lock as defined in claim 7 in which said barrier includes a pin projecting radially of said lock plug and generally aligned with said key slot having a recess therein generally aligned with said key slot and opening toward said plug outer end receiving a portion of said key inner end therein when said key is positioned in said final operable position in said plug key slot.

11. In a lock as defined in claim 7 in which said barrier includes a pin projecting radially of said lock plug and generally aligned with said key slot having a recess therein generally aligned with said key slot and opening toward said plug outer end receiving a portion of said key inner end therein when said key is positioned in said final operable position in said plug key slot, said pin being positioned in a generally cylindrical pin hole extending radially of said lock plug and generally aligned with said key slot.

12. In a lock of the type having a rotatable lock plug with a key slot axially therethrough, the key slot being adapted to receive a proper key inserted axially into an outer end of the lock plug and into a final operable position with an inner end of the key within the lock plug spaced axially from an inner end of the plug, an axially extending torque blade operably connected to the inner end of the plug through a limited lost motion drive permitting limited relative rotation between the plug and torque blade and rotative driving connection therebetween at ends of the limited lost motion drive; the improvements comprising: a barrier in said lock plug having a substantially flat central portion extending radially across and axially blocking said key slot axially between said key inner end and said torque blade when said key is positioned in said final operable position in said plug key slot, said barrier having edge portions received in radial recesses of said lock plug opening radially into said key slot retaining said barrier against axial movement in either axial direction, all portions of said barrier being free of rotation limiting contact with said torque blade; said barrier including a pin extending radially of said lock plug generally aligned with said key slot and having said substantially flat central portion extending radially across and axially blocking said key slot, said pin edge portions projecting arcuately forwardly axially toward said plug outer end forming a recess in said pin axially toward said plug outer end receiving a portion of said key inner end therein when said key is positioned in said final operable position in said plug key slot.

13. In a lock of the type having a rotatable lock plug with a key slot axially therethrough, the key slot being adapted to receive a proper key inserted axially into an outer end of the lock plug and into a final operable position with an inner end of the key within the lock plug spaced axially from an inner end of the plug, an axially extending torque blade operably connected to the inner end of the plug through a limited lost motion drive permitting limited relative rotation between the plug and torque blade and rotative driving connection therebetween at ends of the limited lost motion drive; the improvements comprising: a barrier in said lock plug having a substantially flat central portion extending radially across and axially blocking said key slot axially between said key inner end and said torque blade when said key is positioned in said final operable position in said plug key slot, said barrier having edge portions received in radial recesses of said lock plug opening radially into said key slot retaining said barrier against axial movement in either axial direction, said barrier edge portions projecting arcuately forwardly adjacent said plug key slot axially toward said plug outer end, all portions of said barrier being free of rotation limiting contact with said torque blade.

14. In a lock as defined in claim 13 in which said barrier flat central portion and said barrier edge portions define a barrier recess opening axially toward said plug outer end receiving a portion of said key inner end therein when said key is positioned in said final operable position in said plug key slot.

* * * * *